US007631773B1

(12) United States Patent
Calabrisotto et al.

(10) Patent No.: US 7,631,773 B1
(45) Date of Patent: Dec. 15, 2009

(54) PERSONAL ROLLING VALET

(76) Inventors: DiAnne Calabrisotto, 103 Beagle Dr., Manalapan, NJ (US) 07726; Janice Savin, 1185 Park Ave., Apt. 6K, New York, NY (US) 10128

( * ) Notice: Subject to any disclaimer, the term of this patent is extended or adjusted under 35 U.S.C. 154(b) by 0 days.

(21) Appl. No.: 12/001,874

(22) Filed: Dec. 13, 2007

(51) Int. Cl.
*A47B 43/00* (2006.01)

(52) U.S. Cl. ..... 211/196

(58) Field of Classification Search ..... 211/196, 211/205, 203, 171, 189, 128.1, 197, 175, 211/207; 248/414, 245
See application file for complete search history.

(56) References Cited

U.S. PATENT DOCUMENTS

| | | | | | |
|---|---|---|---|---|---|
| 1,107,075 | A | * | 8/1914 | Karges | 403/63 |
| 1,221,517 | A | * | 4/1917 | Dunbar | 211/70 |
| 1,243,173 | A | * | 10/1917 | Hinckley | 211/62 |
| 1,305,512 | A | * | 6/1919 | Bax | 248/124.1 |
| 2,604,214 | A | * | 7/1952 | Fussell | 211/207 |
| 3,862,735 | A | * | 1/1975 | Cohen | 248/405 |
| 4,351,441 | A | * | 9/1982 | Schramm | 211/207 |
| 4,678,195 | A | | 7/1987 | Trubiano | 280/33.99 |
| 4,770,303 | A | * | 9/1988 | Boyd | 211/205 |
| 4,946,048 | A | * | 8/1990 | Francois | 211/34 |
| 4,971,204 | A | * | 11/1990 | Alsobrook | 211/85.13 |
| 5,203,579 | A | | 4/1993 | Lipschitz | 280/33.991 |
| 5,234,115 | A | * | 8/1993 | Lin | 211/196 |
| D348,079 | S | * | 6/1994 | Bogen | D19/75 |
| D348,999 | S | * | 7/1994 | Bonazza | D6/486 |
| 5,509,545 | A | * | 4/1996 | Banke | 211/205 |
| 5,772,050 | A | * | 6/1998 | Shih | 211/39 |
| 5,819,961 | A | * | 10/1998 | Harris | 211/196 |
| 5,839,586 | A | * | 11/1998 | Smith | 211/163 |
| 5,894,944 | A | * | 4/1999 | Swift | 211/78 |
| 5,906,277 | A | * | 5/1999 | Vienneau | 206/315.1 |
| D440,370 | S | | 4/2001 | Keshishian | D34/23 |
| 6,216,886 | B1 | * | 4/2001 | Considine | 211/85.23 |
| 6,241,105 | B1 | | 6/2001 | Pomper | 211/85.2 |
| D463,160 | S | | 9/2002 | Chang | D6/411 |
| D463,679 | S | | 10/2002 | Chang | D6/411 |
| 6,726,033 | B2 | * | 4/2004 | Sparkowski et al. | 211/85.3 |
| 6,805,366 | B1 | | 10/2004 | Seara | 280/47.26 |
| 6,808,078 | B2 | * | 10/2004 | Ta | 211/116 |
| 6,913,230 | B2 | * | 7/2005 | Wells | 248/127 |
| 7,159,728 | B2 | * | 1/2007 | Smith | 211/166 |
| 2001/0015535 | A1 | * | 8/2001 | Weck et al. | 280/47.315 |
| 2005/0082244 | A1 | * | 4/2005 | Ho | 211/85.23 |
| 2006/0091096 | A1 | * | 5/2006 | Velez et al. | 211/194 |
| 2007/0235400 | A1 | * | 10/2007 | Wald | 211/85.7 |

* cited by examiner

*Primary Examiner*—Sarah Purol
(74) *Attorney, Agent, or Firm*—Goldstein Law Offices, PC

(57) ABSTRACT

A personal rolling valet, for use organizing, supporting, and transporting several clothes outfits, having a vertical shaft. The vertical shaft has a top and a bottom. A horizontal rack is attached to the vertical shaft near the top. The horizontal rack has a pair of opposed hooked portions for supporting several clothes outfits. A lower rack is attached to the vertical shaft near the bottom. The lower rack has a hub attached to the vertical shaft, an outer ring, and spokes connecting the hub and outer ring. The outer ring has an opening between a pair of the spokes which facilitates stacking more than one personal rolling valet.

13 Claims, 8 Drawing Sheets

PERSONAL ROLLING VALET

BACKGROUND OF THE INVENTION

The invention relates to a personal rolling valet. More particularly, the invention relates to a personal valet that allows clothes to be efficiently organized, for use while at home or when shopping.

As the size of a person's wardrobe expands, so does the need for tools which help to effectively organize and coordinate outfits. Such organizational tools are helpful not only prior to dressing, but also when actually dressing and while shopping for new outfits.

When sorting and organizing clothes, one quickly runs out of hands. Accordingly, when going through the closet—either selecting an outfit for a single occasion, or the outfits for an entire week—clothes get tossed onto a bed, or sometimes even onto the floor. This is not a preferred way to care for fine garments.

Similarly, when shopping in a clothing store, it is easy to become overwhelmed: carrying an ever-expanding pile of clothes over one arm while hunting through the store to see if there is anything else interesting to buy. At a certain point, however, it becomes too much and too tiring, and the shopper cuts the browsing short to head toward the checkout counter. This is unfortunate, as it results not only in lost opportunities for the shopper but also in lost sales for the store.

U.S. Pat. No. 4,678,195 to Trubiano discloses a shopping cart apparel hanger. Trubiano requires use of an already existing shopping cart. Trubiano is also limited in capacity, and provides little versatility. Accordingly, it might be somewhat helpful in some shopping circumstances, but fails to be useful for other clothing organizing needs.

U.S. Pat. No. 5,203,579 to Lipschitz discloses a clothes shopping cart. Lipschitz is not readily adjustable to meet the needs of the user.

U.S. Pat. No. 6,805,366 to Searra discloses a portable shopping cart apparatus. Searra is large and cumbersome, and is not stackable.

U.S. Pat. Nos. D440,370 to Keshishian, D463,679 to Chang, and D463,160 to Chang each disclose shopping rack designs. Each of these designs is clearly intended for a specific purpose, but is lacking is the versatility required to meet the needs of consumers.

While these units may be suitable for the particular purpose employed, or for general use, they would not be as suitable for the purposes of the present invention as disclosed hereafter.

SUMMARY OF THE INVENTION

It is an object of the invention to produce a personal valet that helps the user to organize numerous outfits in a convenient manner. Accordingly, the personal valet includes a horizontal rack, which allows numerous clothing outfits to be hung, and a lower rack, which allows shoes and other accessories to be held.

It is another object of the invention to provide a personal valet that is mobile, allowing it to be easily moved from location to location. Accordingly, the personal valet has caster wheels which allow it to roll, allowing it to be easily transported from room to room when dressing, or around a store when shopping.

It is a further object of the invention to provide a personal valet that is adjustable and readily adaptable to varying circumstances of use. Accordingly, the valet has a vertical shaft that supports the horizontal rack. The vertical shaft is capable of telescoping and can accommodate one or more additional horizontal racks if desired. In addition, a clip and associated purse hook allows a purse or other accessories to be supported upon the vertical shaft.

It is yet a further object of the invention to provide a personal valet that is stackable, so as to require minimum space—especially when used in a crowded store. Accordingly, the lower rack has an open quadrant, allowing the vertical shaft of a unit stacked immediately below it to extend upwardly along its own vertical shaft. A clip assembly allows the vertical shafts to be connected together to facilitate stability of the stacked arrangement of personal valets.

It is a still further object of the invention to provide a personal valet that allows numerous outfits to be simultaneously organized thereon. Accordingly, a secondary horizontal rack can be easily added onto the vertical shaft. The secondary horizontal rack can be placed at any desired height on the vertical shaft, and offset angularly from the other horizontal rack to maximize capacity of the valet.

The invention is a personal rolling valet, for use organizing, supporting, and transporting several clothes outfits, having a vertical shaft. The vertical shaft has a top and a bottom. A horizontal rack is attached to the vertical shaft near the top. The horizontal rack has a pair of opposed hooked portions for supporting several clothes outfits. A lower rack is attached to the vertical shaft near the bottom. The lower rack has a hub attached to the vertical shaft, an outer ring, and spokes connecting the hub and outer ring. The outer ring has an opening between a pair of the spokes which facilitates stacking more than one personal rolling valet.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
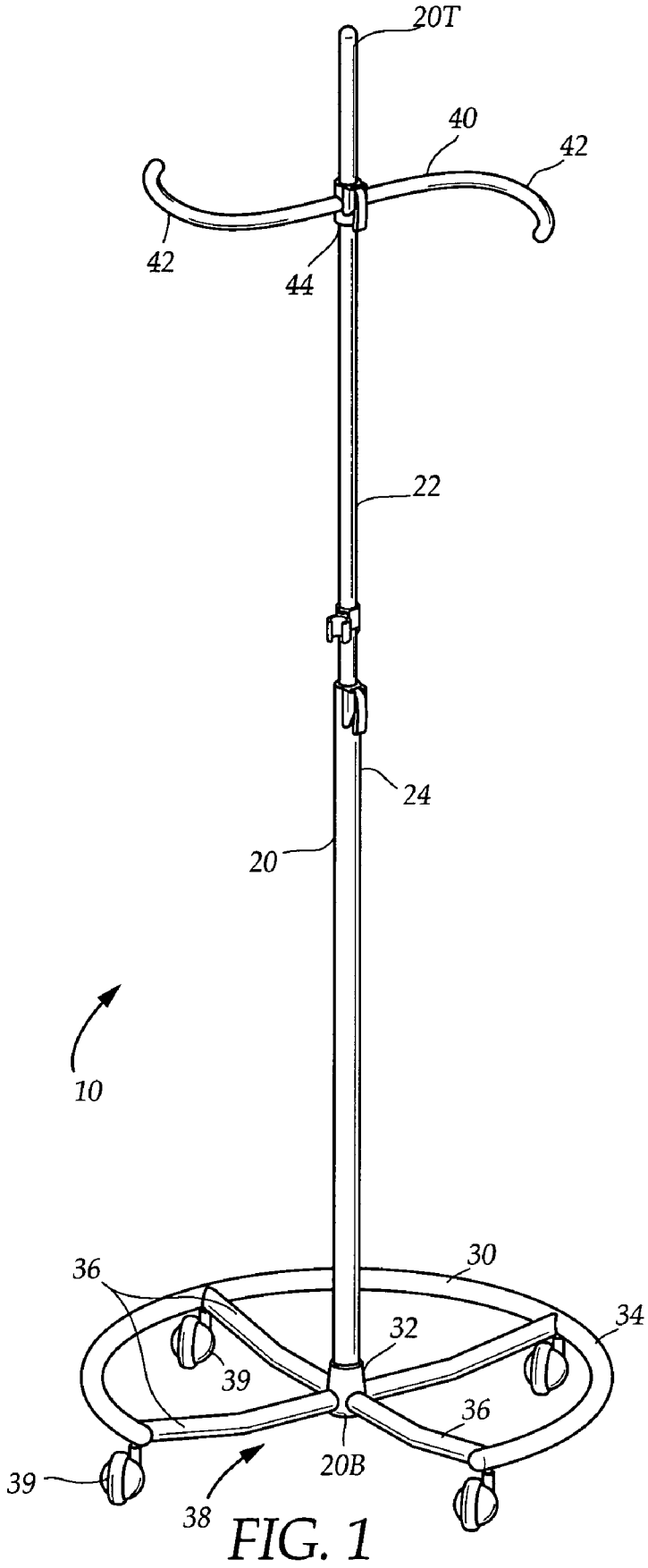
FIG. 1 is a diagrammatic perspective view, illustrating the personal valet according to the present invention, per se.

FIG. 1 illustrates a personal valet 10 according to the present invention. The personal valet 10 includes a vertical shaft 20, having a top 20T and a bottom 20B. The vertical shaft 20 is cylindrical and is configured telescopically to adjust in height. Accordingly, the vertical shaft 20 comprises an upper shaft 22 and a lower shaft 24. The upper shaft is coaxial with the lower shaft 24 and is capable of raising and lowering with respect thereto to adjust an overall distance between the top 20T and bottom 20B of the vertical shaft 20.

A lower rack 30 is attached at the bottom 20B of the vertical shaft 20. The lower rack 30 includes a hub 32 which is directly attached to the bottom 20B of the vertical shaft 20, and an outer ring 34 extends horizontally and which is substantially concentric with the vertical shaft 20 and hub 32. Spokes 36 extend radially outward from the hub 32 and are separated by substantially ninety degrees between each adjacent spoke. The spokes 36 connect the outer ring 34 to the hub 32. The outer ring 34 is not continuous, however. The lower rack 30 has an open quadrant 38, such that the outer ring 34 is essentially missing between two of the spokes 36, creating an opening that facilitates stacking, as will be further described and demonstrated hereinbelow. A plurality of caster wheels 39 are mounted to the outer ring 34, to allows the personal valet 10 to be easily transported on any flooring surface.

A horizontal rack 40 is attached to the vertical shaft 20 near the top 20T. The horizontal rack has a collar 44 that facilitates attachment onto the vertical shaft 20. The horizontal rack is configured to facilitate organizing clothing outlets thereon. Generally clothing outfits on hangers are hung directly from the horizontal rack 40. The horizontal rack is substantially S-shaped, having two opposing hooked portions 42 that extend laterally outwardly from the collar 44. Tabs can be easily placed on the hooked portions 42 to separate outfits for various days of the weeks, or to otherwise organize the outfits as desired by the user.

Figure 2:
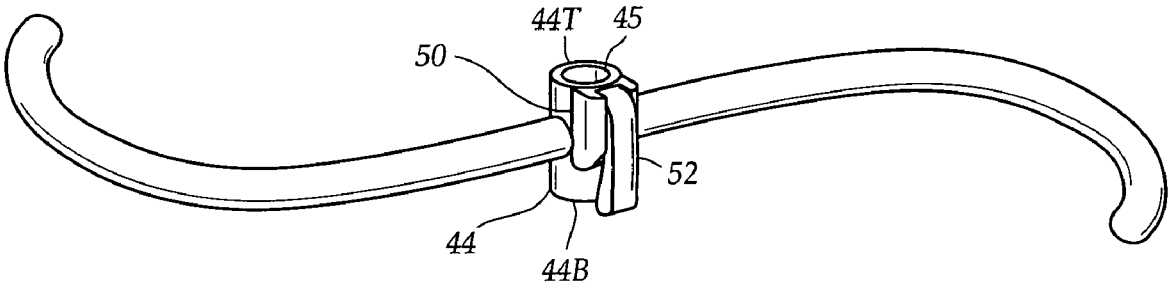
FIG. 2 is a diagrammatic perspective view, illustrating one of the horizontal racks.
Figure 5A:
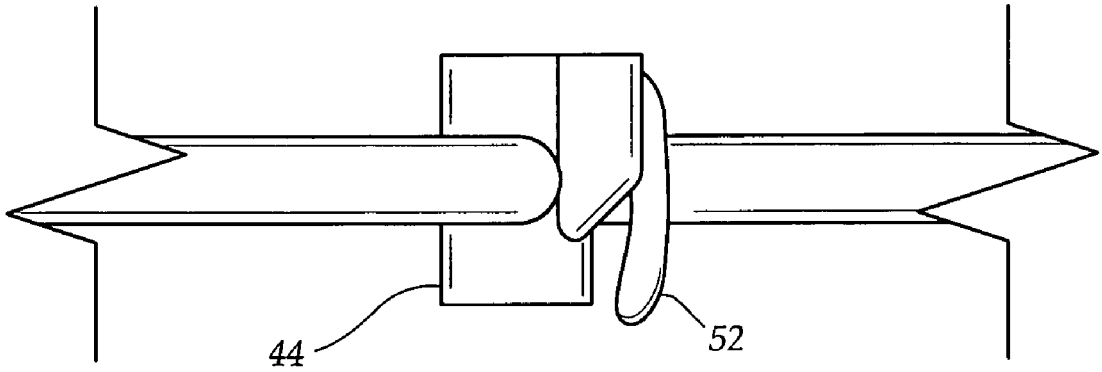
FIG. 5A and FIG. 5B illustrate the cam tightening mechanism on the horizontal rack in the closed, and open position, respectively, such that they hold the horizontal rack in position, allow its height adjustment on the vertical shaft, or allow its removal from the vertical shaft.
Figure 5B:
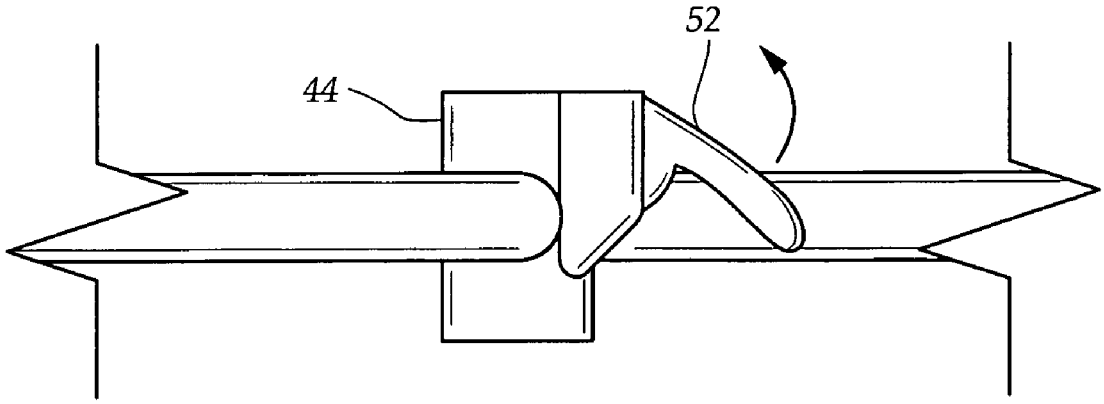

Referring to FIG. 2, the collar 44 facilitates attachment onto the vertical shaft 20. The collar 44 has a top 44T, a bottom 44B, and a vertical bore 45 extending fully between the top and bottom 44B. The vertical bore 45 allows the vertical shaft 20 to extend through the collar 44. The collar 44 has a cam tightening mechanism 50, including a cam lever 52, which facilitates securing to the vertical shaft 20 at a particular location thereon, and also allows adjustment in height thereon, or removal therefrom. Referring to FIG. 5A, when the cam lever 52 is in a downward position, extending substantially parallel to the vertical shaft 20, the collar 44 tightens upon the vertical shaft 20 extending therethrough. Referring to FIG. 5B, when the cam lever 52 is in an upward position, the collar 44 loosens upon the vertical shaft 20, allowing the collar 44 to be adjusted in height, or fully removed from the vertical shaft 20.

Figure 4:
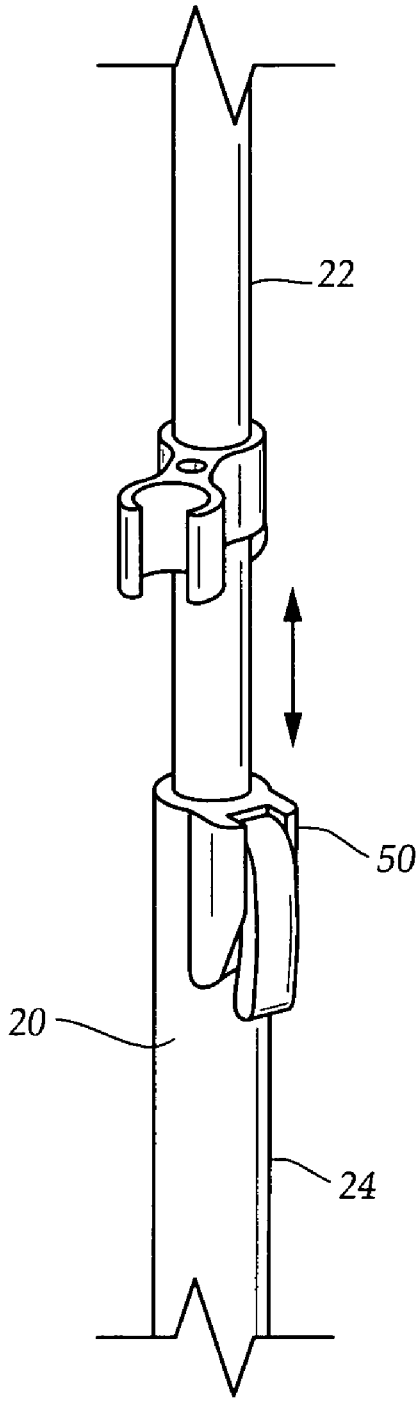
FIG. 4 is a side elevational view, illustrating the telescoping nature of the vertical shaft, and cam tightening mechanism. The clip assembly is shown mounted on the upper shaft.

Referring to FIG. 4, the vertical shaft 20 also employs the cam tightening mechanism 50. In particular, the cam tightening mechanism 50 is mounted on the lower shaft 24, and selectively allows or prevent relative vertical movement of the upper shaft 22 as shown by selectively loosening or tightening its grip upon the upper shaft 22.

Figure 3:
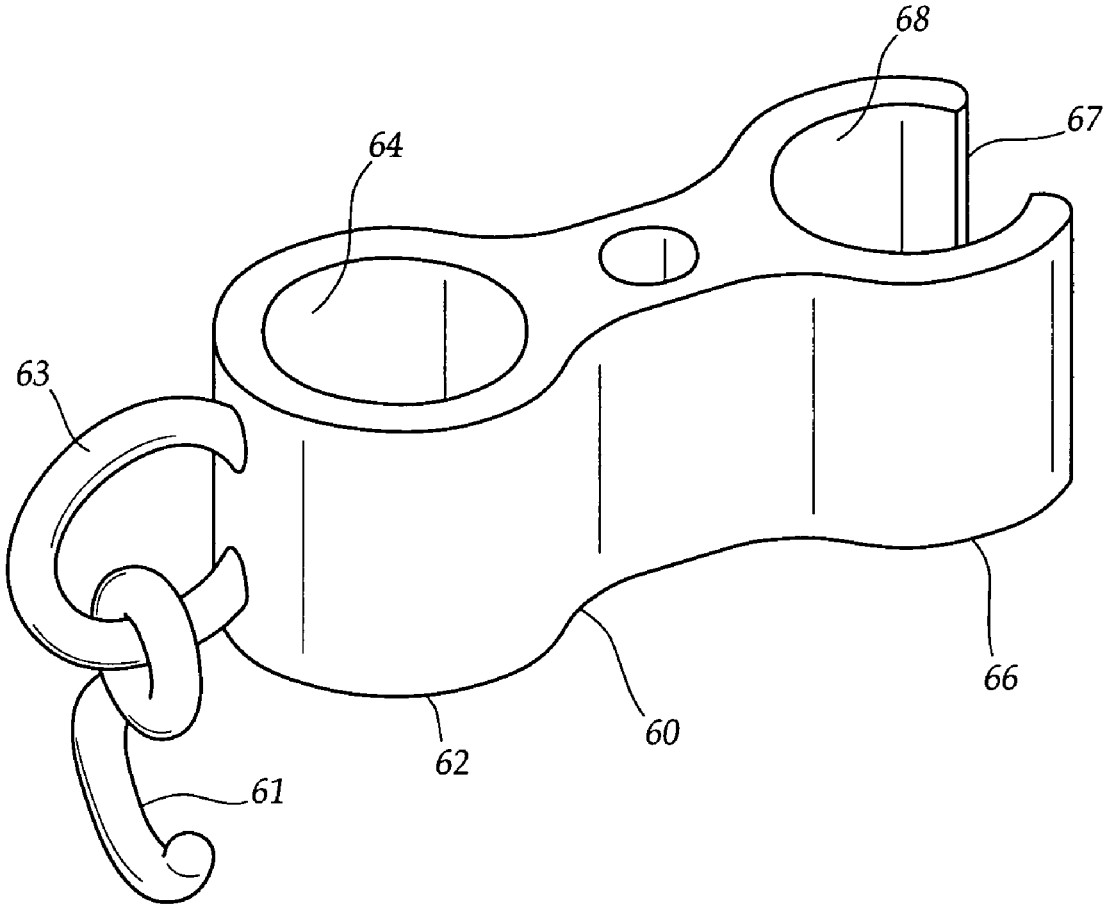
FIG. 3 is a diagrammatic perspective view, illustrating the clip assembly, with accompanying purse hook.

FIG. 3 illustrates a clip 60, which has a main portion 62, having a main bore 64, and an open portion 66, having a clip opening 67 and an open bore 68. The main bore 64 is sized to fit snugly upon the vertical shaft 20—preferably the upper shaft 22 thereof. The open portion 66 is sized to also sized to fit snugly upon the vertical shaft 20. Accordingly, the clip 60 is preferably made of rubber, or a similar material. The clip opening 67 extends vertically, parallel to the main bore 64 and is configured to allow the vertical shaft 20 to be pressed into the open bore 68, such that the clip flexes and expands the clip opening 67 momentarily to allow the vertical shaft 20 to extend fully into the open bore 68 at which time the clip flex to close the clip opening 67 so as to securely hold the vertical shaft 20 therein. The clip also has a purse hook 61, which is secured the main portion 62 with a ring 63. The purse hook 61 conveniently allows a user to hang a purse while shopping, or can be used to hold accessories when dressing or arranging outfits. It can also be used to support a mesh bag that holds additional clothing items.

Figure 6:
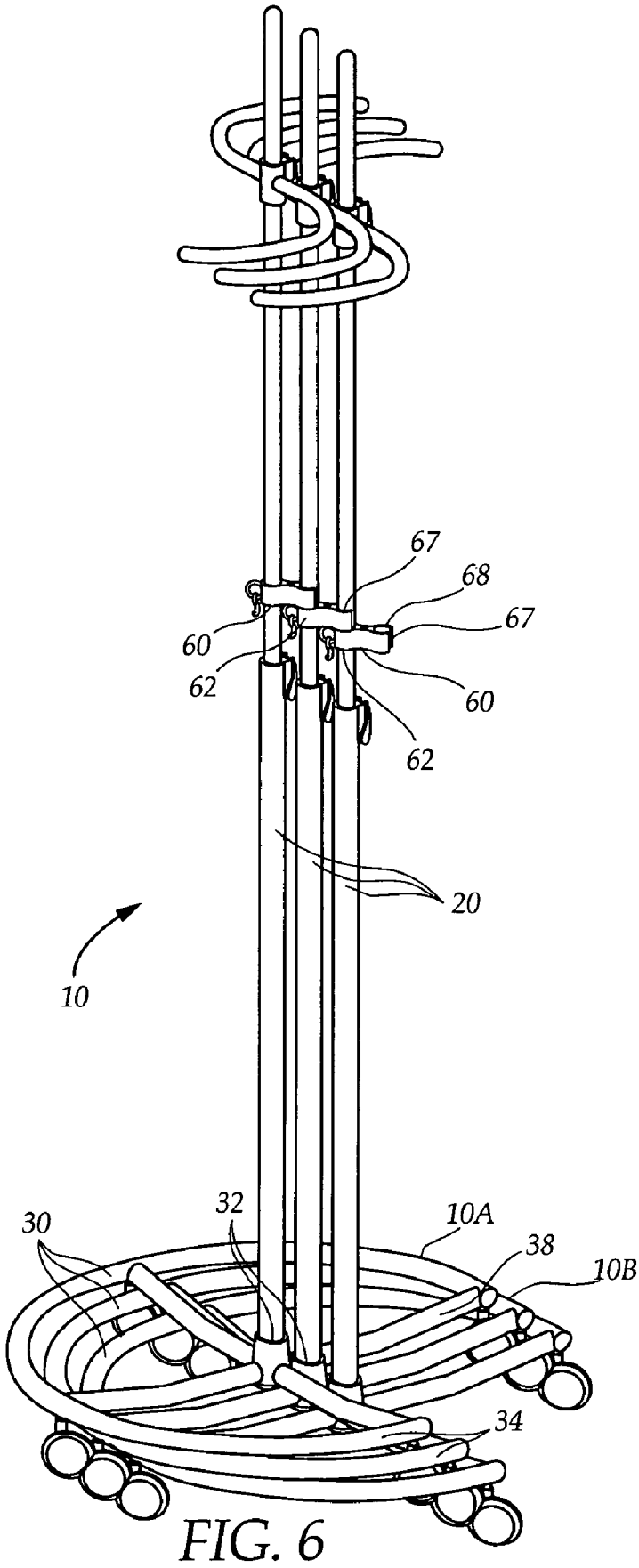
FIG. 6 is a diagrammatic perspective view, illustrating the stacking of multiple personal valets.

FIG. 6 illustrates how the clip 60 facilitates the stacking of multiple personal valets 10. In particular, the clip 60 secures together the vertical shafts 20 of adjacent personal valets 10, whereas one of the vertical shafts 20 extends through the main portion 62 of the clip 60, and the other vertical shaft 20 is urged through the clip opening 67 and into the open bore 68.

Further facilitating the stacking of multiple personal valets 10 is the configuration of the lower rack 30. In fact, it is this configuration that makes stacking possible. In particular, with regard to the stacking of two personal valets 10, wherein one is located above 10A, and the other below 10B: the vertical shaft 20 of the personal valet located below 10B extends upwardly through the open quadrant 38 of the lower rack 30 of the personal valet located above 10A. The hub 32 of the one below 10B extends nearly alongside (allow slightly lower than) the hub 32 of the personal valet above 10A. The outer rings 34 of the valet above 10A and valet below 10B are nearly coincident, yet are offset by substantially the size of the hub 32. At the same time, the vertical shaft 20 of the personal valet below 10B mates with the clip 60 belonging to the vertical shaft 20 of the personal valet above 10A.

Figure 7:
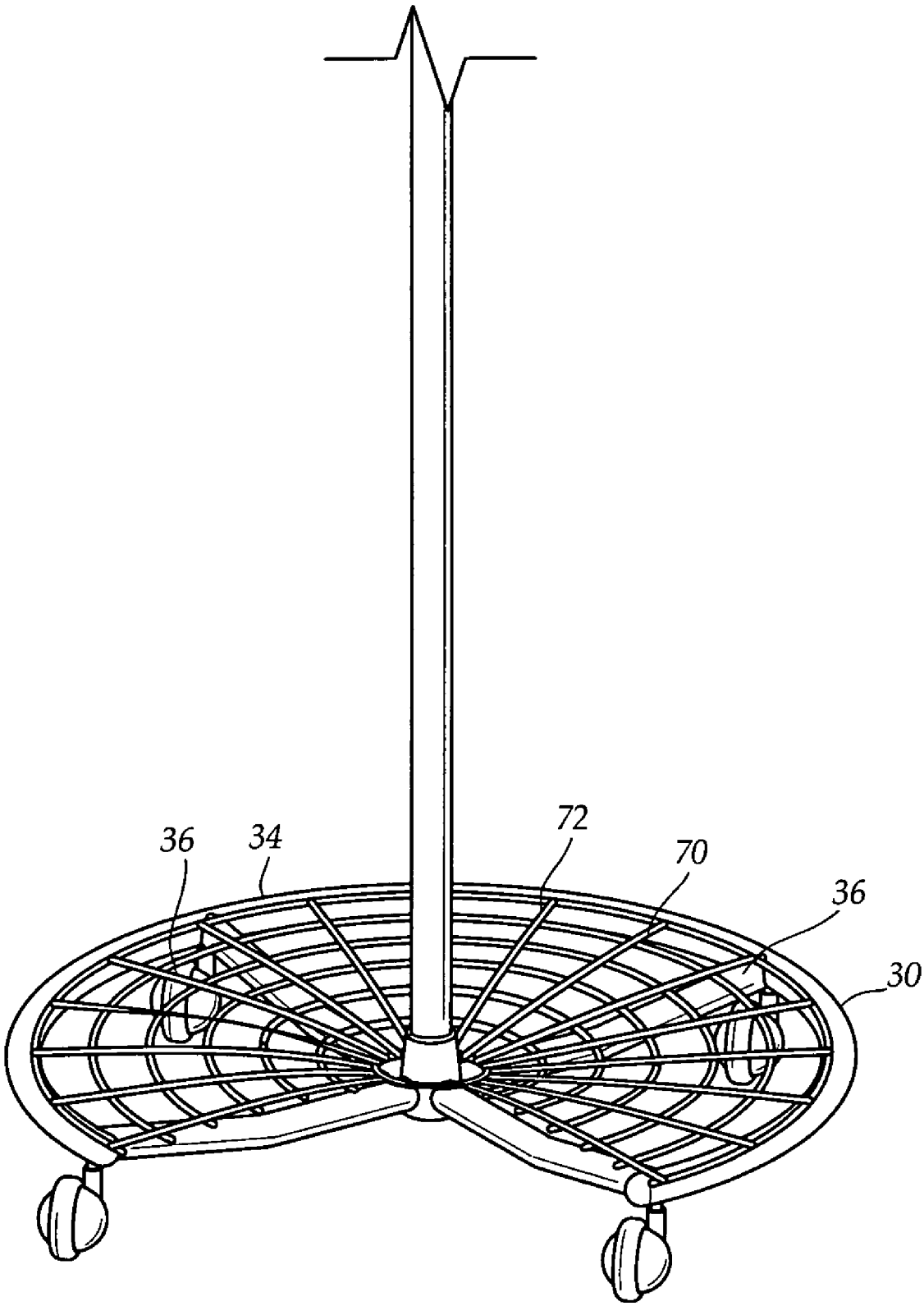
FIG. 7 is a diagrammatic perspective view, illustrating a further embodiment of the lower rack.

FIG. 7 illustrates a further embodiment of the lower rack 30. In particular, the lower rack 30 is covered with an item retaining net 70. In particular, the net 70 has small opening 72 that are considerably smaller than a region formed by two adjacent spokes 36 and the outer ring 34. Accordingly, the net 70 allows various items to be placed on the lower rack 30, such as shoes and other accessories. The net 70 may be made of a rigid material (and thus be more like a grating), or may be made of textiles, forming a flexible net having similar properties as, for example, a fishing net.

Figure 8:
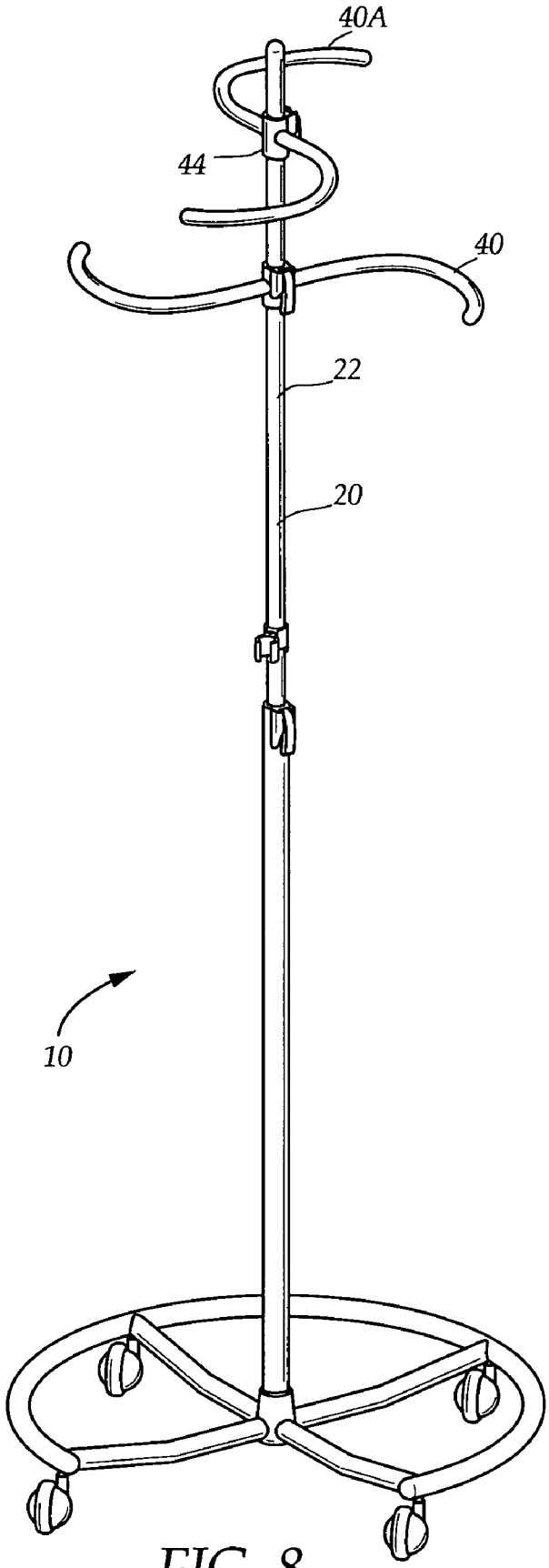
FIG. 8 is a diagrammatic perspective view, illustrating an additional horizontal rack attached onto the vertical shaft.

FIG. 8 illustrates a further embodiment of the personal valet 10, wherein a secondary horizontal rack 40A is attached to the vertical shaft 20, to supplement the other, already existing horizontal rack 40. In particular, the collar 44 of the supplemental horizontal rack 40A is simply slid over the top 20T of the vertical shaft 20 on to the upper shaft 22. As illustrated, the secondary horizontal rack 40A can be oriented in a different angular position than the horizontal rack 40, to allow quantities of clothing to be hung from each without interfering with each other. In particular, the supplemental horizontal rack 40A is at a substantially ninety degree angle form the horizontal rack 40. In addition, since the collar 44 allows free movement upon the vertical shaft, either of the horizontal racks 40, 40A can be raised or lowered at will. Accordingly the heights of the horizontal rack 40 and the secondary horizontal rack 40A can be staggered considerably to maximize capacity of the personal valet 10 by providing even more storage space.

In conclusion, herein is presented a rolling personal valet which allows clothes to be organized, supported, and transported by a user. The invention is illustrated by example in the drawing figures, and throughout the written description. It should be understood that numerous variations are possible, while adhering to the inventive concept. Such variations are contemplated as being a part of the present invention.

What is claimed is:

1. A personal valet, for use organizing, supporting, and transporting clothing outfits by a user, comprising:

a vertical shaft, having a top and a bottom;

a lower rack, comprising a hub that is secured to the bottom of the vertical shaft, a horizontally extending outer ring that is substantially concentric with the vertical shaft and hub, a plurality of spokes that connect the hub and outer ring;

a plurality of wheels mounted beneath the lower rack; and a horizontal rack, attached to the vertical shaft, the horizontal rack having a collar which is secured onto the vertical shaft and allows the horizontal rack to be selectively adjusted in height on the vertical shaft, and a pair of opposed hooked portions that together are substantially s-shaped and extend laterally outwardly from the collar, substantially horizontally, for supporting clothes on hangers; and wherein the outer ring of the primary personal valet has an opening between two of the spokes for facilitating stackability with other personal valets substantially as previously recited.

2. The personal valet as recited in claim 1, further comprising a clip, the clip having a main portion and an open portion, the main portion having a main bore for allowing the vertical shaft to extend therethrough for securing to the personal valet, the open portion having an open bore and a clip opening extending vertically adjoining the open bore, parallel to the main bore, the clip opening flexes to allow a vertical shaft from another personal valet to extend into the open bore and then flexes back to retain said vertical shaft so as to hold both vertical shafts together when stacking both of said personal valets.

3. The personal valet as recited in claim 2, wherein the clip has a main portion, and has a purse hook which is secured to the main portion with a ring, the purse hook allowing objects to be supported from the vertical shaft.

4. The personal valet as recited in claim 3, wherein the collar has a cam lever which selectively causes the collar to tighten on the vertical shaft to selectively maintain a vertical position of the horizontal rack on the vertical shaft, or to selectively allow height adjustment of the horizontal rack.

5. The personal valet as recited in claim 4, further comprising a secondary horizontal rack, having a collar for mounting on the vertical shaft and a pair of hooked portions extending laterally outward from the collar, the secondary horizontal rack allowing additional clothing outfits to be supported therefrom.

6. The personal valet as recited in claim 1, wherein the lower rack is covered by a net, spanning between the outer ring and spokes, except at the opening between two of the spokes, the net for supporting items thereupon.

7. The personal valet as recited in claim 5, wherein the vertical shaft is capable of telescoping, having an upper shaft, and a lower shaft that extends within the lower shaft.

8. The personal valet as recited in claim 7, wherein the lower shaft has a cam lever to selectively allow the upper shaft to be adjusted in height with respect to the lower shaft, and for selectively fixing the relative position of the upper shaft and lower shaft.

9. The personal valet as recited in claim 1, further comprising a clip, the clip having a main portion and an open portion, the main portion having a main bore for allowing the vertical shaft to extend therethrough for securing to the personal valet, the open portion having an open bore and a clip opening extending vertically adjoining the open bore, parallel to the main bore, the clip opening flexes to allow a vertical shaft from another personal valet to extend into the open bore and then flexes back to retain said vertical shaft so as to hold both vertical shafts together when stacking both of said personal valets.

10. The personal valet as recited in claim 9, wherein the vertical shaft is capable of telescoping, having an upper shaft, and a lower shaft that extends within the lower shaft.

11. The personal valet as recited in claim 10, wherein the lower rack is covered by a net, spanning between the outer ring and spokes, except at the open quadrant.

12. The personal valet as recited in claim 11, wherein the clip has a main portion, and has a purse hook which is secured to the main portion with a ring, the purse hook allowing objects to be supported from the vertical shaft.

13. The personal valet as recited in claim 12, wherein the lower shaft has a cam lever to selectively allow the upper shaft to be adjusted in height with respect to the lower shaft, and for selectively fixing the relative position of the upper shaft and lower shaft.

* * * * *